US009387145B2

(12) United States Patent
Ohta et al.

(10) Patent No.: US 9,387,145 B2
(45) Date of Patent: Jul. 12, 2016

(54) CARE SUPPORT APPARATUS

(71) Applicant: JTEKT CORPORATION, Osaka-shi (JP)

(72) Inventors: Hiromichi Ohta, Kariya (JP); Manabu Kanaya, Nara (JP)

(73) Assignee: JTEKT CORPORATION, Osaka-shi (JP)

( * ) Notice: Subject to any disclaimer, the term of this patent is extended or adjusted under 35 U.S.C. 154(b) by 23 days.

(21) Appl. No.: 14/754,009

(22) Filed: Jun. 29, 2015

(65) Prior Publication Data

US 2016/0008207 A1 Jan. 14, 2016

(30) Foreign Application Priority Data

Jul. 8, 2014 (JP) ..... 2014-140469

(51) Int. Cl.
*A61H 3/04* (2006.01)
*A61H 3/00* (2006.01)

(52) U.S. Cl.
CPC ..... *A61H 3/04* (2013.01); *A61H 2003/006* (2013.01)

(58) Field of Classification Search
CPC ..... A61H 3/00; A61H 3/04; A61H 2003/043; A61H 2003/006
See application file for complete search history.

(56) References Cited

U.S. PATENT DOCUMENTS 6,311,708 B1 * 11/2001 Howle ..... A61H 3/04 135/67
6,338,355 B1 * 1/2002 Cheng ..... A61H 3/04 135/67
8,201,550 B2 * 6/2012 Malumyan ..... A47J 37/0704 108/109

FOREIGN PATENT DOCUMENTS

JP 2001-187089 A 7/2001
JP 2011-92324 A 5/2011

* cited by examiner

*Primary Examiner* — Jeffrey J Restifo
*Assistant Examiner* — Erez Gurari
(74) *Attorney, Agent, or Firm* — Oblon, McClelland, Maier & Neustadt, L.L.P.

(57) ABSTRACT

A care support apparatus includes a lateral pair of leg links held by a main body. The leg links include first links provided with first wheels at respective one ends of the first links, and second links provided with second wheels at respective one ends of the second links and rotatably coupled to the first links. The second links are rotated to allow the first wheels to approach or leave the second wheels, respectively, to change the height of a main body from a ground surface to support a care receiver.

6 Claims, 8 Drawing Sheets

CARE SUPPORT APPARATUS

INCORPORATION BY REFERENCE

The disclosure of Japanese Patent Application No. 2014-140469 filed on Jul. 8, 2014 including the specification, drawings and abstract, is incorporated herein by reference in its entirety.

BACKGROUND OF THE INVENTION

1. Field of the Invention

The invention relates to a care support apparatus that supports a care receiver's stand-up, transfer, and walking motion.

2. Description of Related Art

Japanese Patent Application Publication No. 2001-187089 (JP 2001-187089 A) discloses a care support apparatus that supports a care receiver's stand-up, transfer, and walking motion, in which a main body includes wheels, a carrier that moves forward and backward and upward and downward, an assistive arm, and a sitting seat and in which the carrier includes a chest support member at a tip of the carrier. The care support apparatus supports the stand-up and transfer motions of the care receiver held by the chest support member by moving the chest support member forward and backward and upward and downward. The care support apparatus supports the walking motion of the care receiver holding the chest support member and assisted and supported at the hip by the assistive arm or supported by a sling installed on the chest support member. Moreover, the care support apparatus can be used as a wheelchair when the care receiver sits in the sitting seat and a caregiver operates the care support apparatus.

Japanese Patent Application Publication No. 2011-92324 (JP2011-92324 A) discloses a care support apparatus that supports the care receiver's stand-up motion and that includes holding sections arranged at respective tips of links pivotally coupled together to hold the care receiver and wheels provided at a lower portion of the apparatus.

When the care receiver makes the stand-up or transfer motion, a strong force acts on the care support apparatus. Consequently, the care support apparatus needs to be stable, and thus, the distance between the wheels is preferably long. When the care receiver makes the walking motion, the distance between the wheels is preferably short in order to facilitate changes in direction of the care support apparatus. In the conventional apparatuses described in JP 2001-187089 A and JP 2011-92324 A, the wheels are fixedly arranged, precluding the optimum distance from being set between the wheels for each motion.

SUMMARY OF THE INVENTION

An object of the present invention is to provide a care support apparatus that extends the distance between wheels for stand-up and transfer motions to improve stability during the stand-up and transfer motions and that shortens the distance between the wheels for walking to facilitate changes in direction.

A care support apparatus that is an aspect of the present invention has a main body and a lateral pair of leg links held by the main body. In the care support apparatus, when a shape of the leg links is changed, the care support apparatus is changed into a form suitable for a care receiver's stand-up, transfer, walking, or movement to support the care receiver's stand-up, transfer, walking, or movement. The leg links include a first link provided with a first wheel at one end of the first link and a second link provided with a second wheel at one end of the second link and coupled to the first link at another end of the second link so as to be rotatable around a first axis. When, with the first wheel and the second wheel in contact with a ground surface, the second link is rotated around the first axis such that the first wheel and the second wheel approach each other, a height of the main body from the ground surface increases.

In the care support apparatus in the above-described aspect, the distance between the first wheel and the second wheel decreases with an increase in height of the main body. An operation of increasing the height of the main body is used to support the care receiver's transfer and stand-up motions. Thus, when the care receiver takes a low posture and a strong force acts on the care apparatus, the distance between the wheels is long and the care support apparatus is very stable. When the care receiver assumes a standing position, the distance between the wheels decreases to facilitate changes in direction during walking. A care support apparatus can be implemented which is very stable during transfer and stand-up and which easily changes the direction during walking.

In the care support apparatus in the above-described aspect, the first link may be held by the main body so as to be rotatable around a second axis parallel to the first axis.

In the care support apparatus in the above-described aspect, since the first link is rotatable with respect to the main body, the angle of the main body with respect to the ground surface can be set to match an orientation suitable for transfer and stand-up or walking.

In the care support apparatus in the above-described aspect, one end of a third link may be coupled to another end of the first link so as to be rotatable around a third axis parallel to the first axis, and another end of the third link may be held by the main body so as to be rotatable around a fourth axis parallel to the first axis.

In the care support apparatus in the above-described aspect, since the one end of the third link is rotatably coupled to the another end of the first link, the degree of freedom of up and down operation of the main body is high. Thus, the optimum position of the main body can be set for transfer and stand-up or walking.

The care support apparatus in the above-described aspect may further include a pair of seat members that is held by the main body or the leg links and is movable, the seat members forming a seat surface by approaching each other.

In the care support apparatus in the above-described aspect, since the seat surface is formed by the seat members approaching each other, the seat members are separately stored when the seat surface is not used. This enables a reduction in storage space, preventing the care receiver's motion from being obstructed.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Embodiments of the present invention will be described below with reference to the attached drawings.

Figure 1:
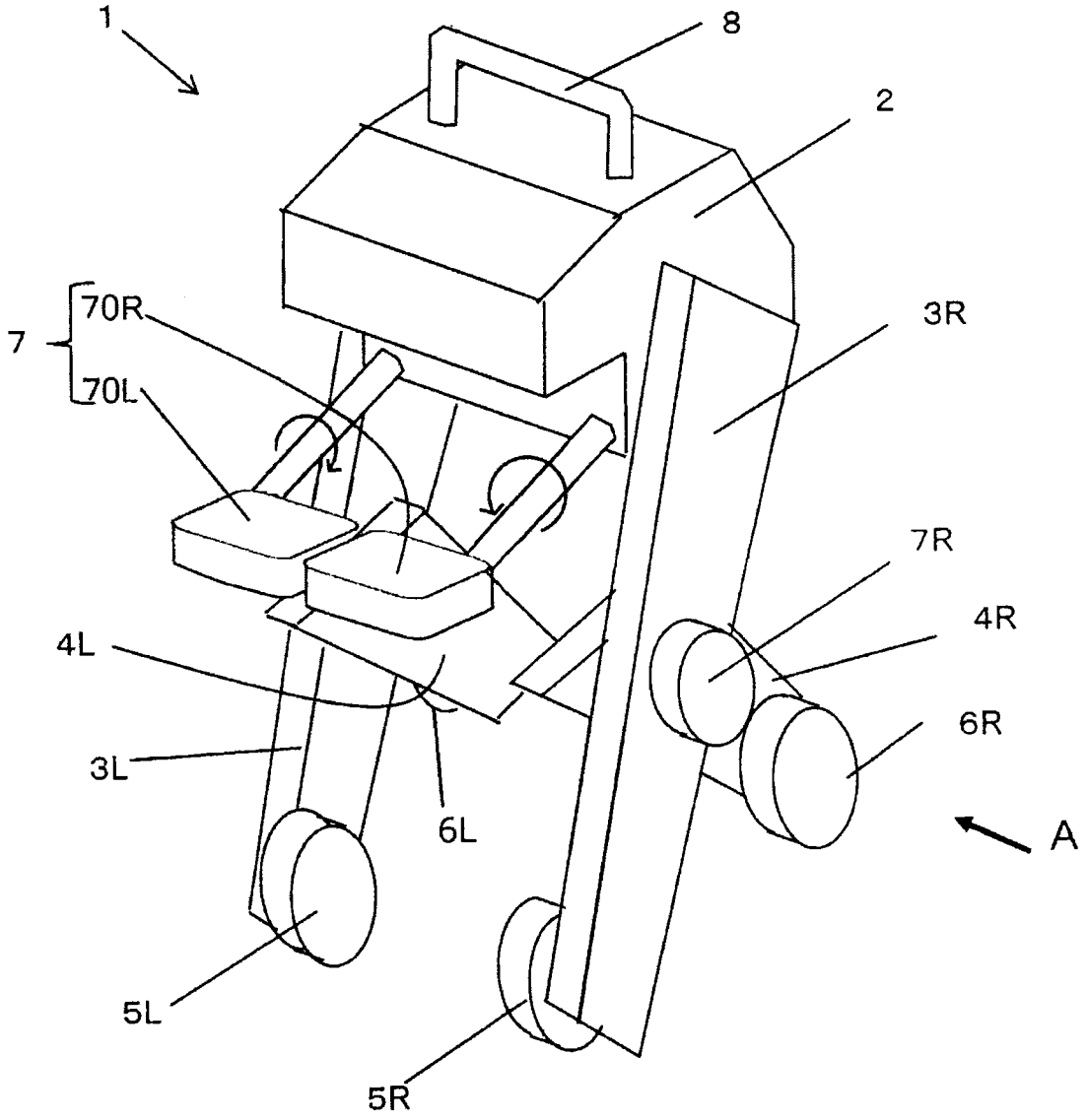
FIG. 1 is a schematic diagram depicting an overall configuration of the present embodiment.
Figure 2:
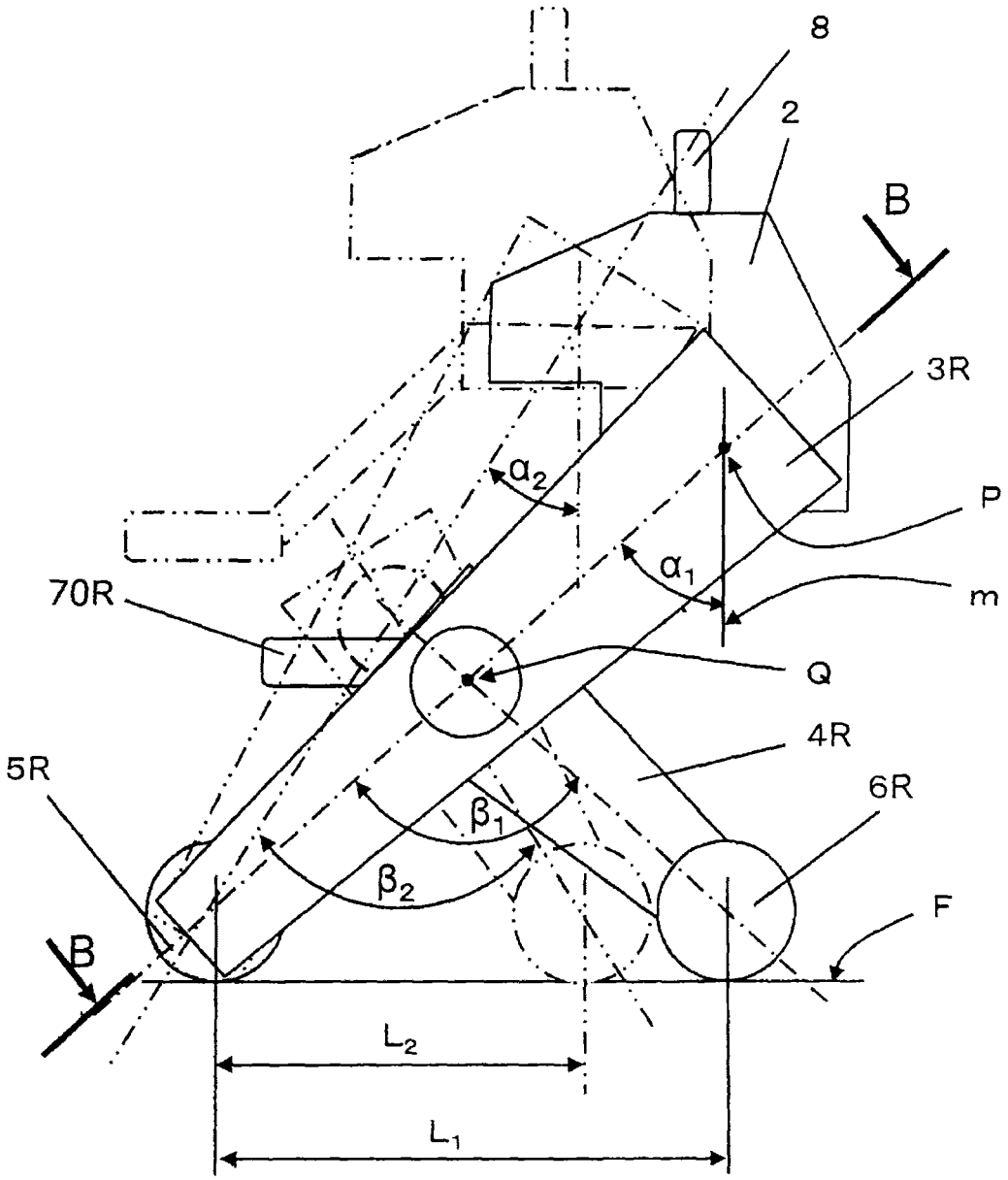
FIG. 2 is a sectional view taken along the direction of arrow A in FIG. 1.
Figure 3:
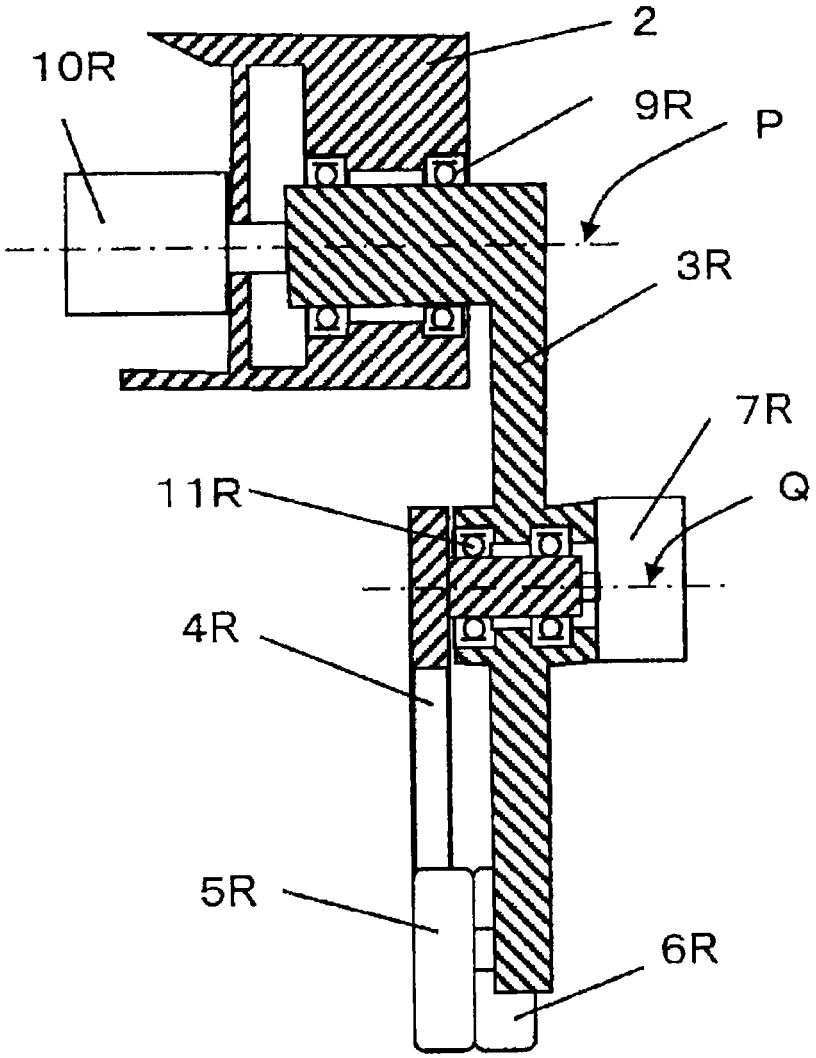
FIG. 3 is a sectional view taken along line B-B in FIG. 2.
Figure 4:
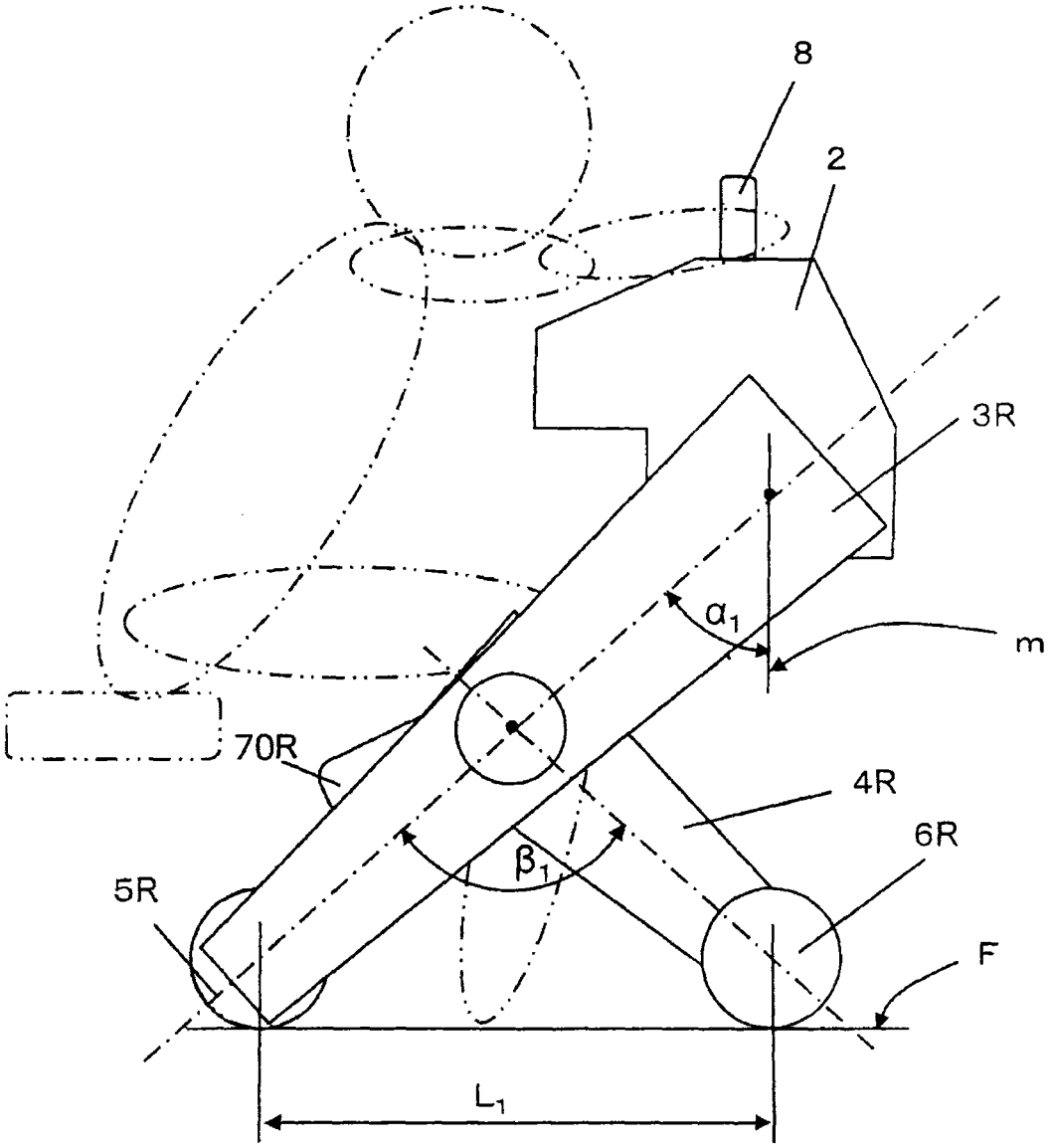
FIG. 4 is a diagram of a care support apparatus when a care receiver uses the care support apparatus in a sitting position.

With reference to FIGS. 1 to 3, a care support apparatus in a first embodiment of the present invention will be described.

As depicted in FIG. 1, a care support apparatus 1 includes, on a right side surface of a main body 2, a first link 3R provided with a first wheel 5R at a lower end of the first link 3R and a second link 4R engaged with an intermediate portion of the first link 3R and provided with a second wheel 6R at a lower end of the second link 4R; the first link 3R and the second link 4R serve as right leg links. The care support apparatus 1 includes, on a left side surface of the main body 2, a first link 3L provided with a first wheel 51 at a lower end of the first link 3L and a second link 4L engaged with an intermediate portion of the first link 3L and provided with a second wheel 6L at a lower end of the second link 4L; the first link 3L and the second link 4L serve as left leg links. The second wheels 6R and 6L may be configured to function as casters or turning wheels.

At the front of the care support apparatus 1, seat members 70R and 70L rotatably held by the main body 2 are arranged. The seat members 70R and 70L each rotate about a rotation axis so as to reduce the distance between the seat members 70R and 70L to approach each other, thus providing a seat surface 7 on which the care receiver can sit. A handle 8 is provided at an upper portion of the main body 2.

As seen in a sectional view of the right leg link depicted in FIG. 3, the first link 3R and the main body 2 are rotatably engaged with each other via a second axis P defined by two bearings 9R. The first link 3R is driven by a motor 10R to rotate around the second axis P with respect to the main body 2. The second link 4R and the first link 3R are rotatably engaged with each other via a first axis Q defined by two bearings 11R. The second link 4R is driven by a motor 7R to rotate around the first axis Q with respect to the main body 2. In the left leg link, each of the first and second links 3L and 4L is similarly rotated by a motor.

In a side view of the right leg link depicted in FIG. 2, an angle $\alpha_1$ is subtended between a line m perpendicular to a ground surface F of the care support apparatus 1 in a low form depicted by a solid line and a straight line connecting the second axis P with the center of rotation of the first wheel 5R. An angle $\beta_1$ is subtended between a straight line connecting the first axis Q with the center of rotation of the first wheel 5R and a straight line joining the first axis Q with the center of rotation of the second wheel 6R. In this case, the distance between the center of rotation of the first wheel 5R and the center of rotation of the second wheel 6R is denoted by $L_1$.

In this state, the second link 4R is rotated clockwise by the motor 7R so as to set an angle $\beta_2$ between the straight line joining the first axis Q with the center of rotation of the first wheel 5R and the straight line joining the first axis Q with the center of rotation of the second wheel 6R. At the same time, the first link 3R is rotated counterclockwise by the motor 10R so as to set an angle $\alpha_2$ between the line m and the straight line joining the second axis P with the center of rotation of the first wheel 5R. Then, the form is changed as depicted by a dashed line to change the distance between the center of rotation of the first wheel 5R and the center of rotation of the second wheel 6R to $L_2$, increasing the distance of the second axis P from the ground surface F. In this case, when the relationship between the rotation angles of the links is expressed by $\beta_1-\beta_2=2\times(\alpha_1-\alpha_2)$, the angle of the main body 2 with respect to the ground surface F is maintained constant.

When used to support the care receiver's transfer or stand-up, the care support apparatus 1 is operated as follows. When the main body 2 is low and the seat member 70R and the seat member 70L are not close to each other and open in a lateral direction and do not form the seat surface 7, the care receiver in a sitting position who is sitting in a chair or the like grips the handle 8, and assumes a position in which the care receiver's upper body lies over the main body 2, as needed.

Figure 5:
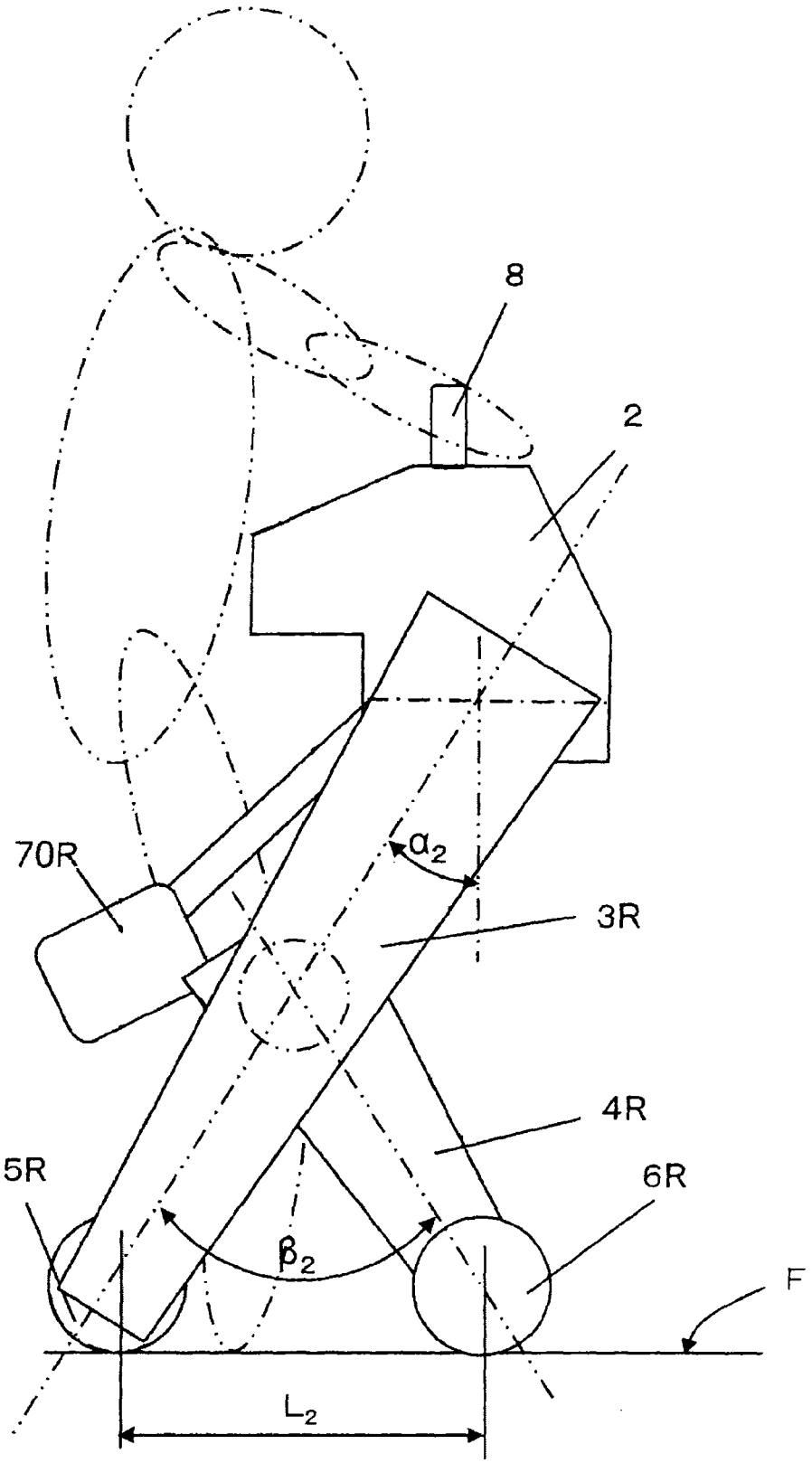
FIG. 5 is a diagram of the care support apparatus when the care receiver uses the care support apparatus in a standing position.

A care receiver operates an operating member not depicted in the drawings to rotate the first link 3R and the second link 4R to raise the main body 2 to a desired height as depicted in FIG. 5. When the care receiver assumes a half-crouching or standing position, the care receiver stops the rotation. In an initial stage of this operation, a strong forward pulling force acts on the care support apparatus 1 in order to pull up the care receiver. However, the distance between the first wheel 5R and the second wheel 6R is long, and the care support apparatus 1 is thus stable.

The care receiver moves and turns the care support apparatus 1 to move to a desired position. At this time, the distance between the first wheel 5R and the second wheel 6R is shortened to reduce a moment of force acting as resistance at the time of the turning, thus facilitating the turning. Furthermore, when the second wheel 6R is a turning wheel, the turning radius of the care support apparatus 1 can be reduced.

The care receiver operates the operating member to rotate the first link 3R and the second link 4R to lower the main body 2 to a desired height. When the care receiver assumes the sitting position at a desired position of the apparatus, the care receiver stops the rotation.

When the care support apparatus 1 is used for gait training for the care receiver, the care receiver in the standing position grips the handle 8 to support the upper body, while pushing the care support apparatus 1 to move in a desired direction as depicted in FIG. 5. At this time, the main body 2 is at a high position, and the distance between the first wheel 5R and the second wheel 6R is short. This reduces a moment of force acting as resistance when the care support apparatus 1 changes its direction, which allows the care receiver to more easily operate the care support apparatus 1.

Figure 6:
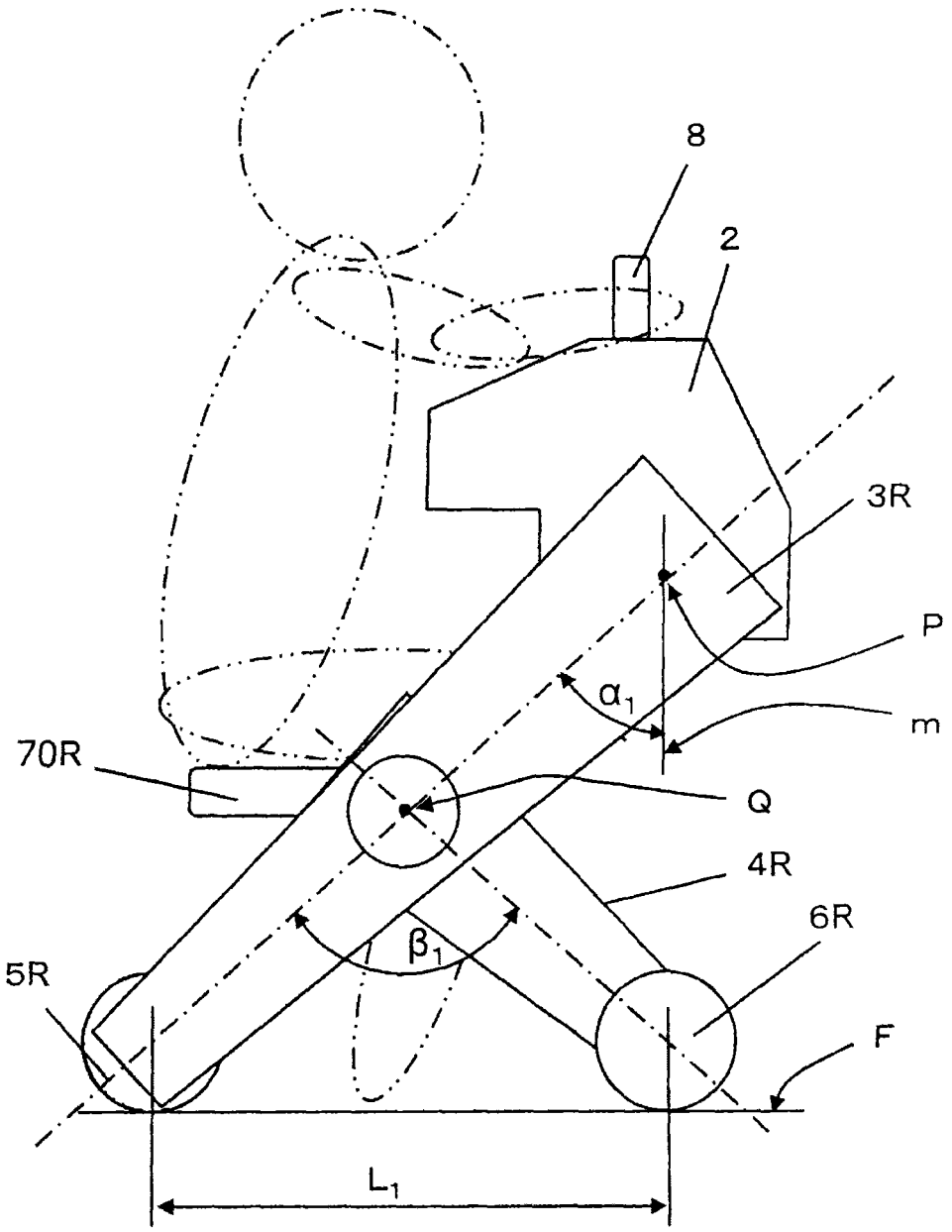
FIG. 6 is a diagram of the care support apparatus when the care receiver uses the care support apparatus as a wheelchair.

When the care receiver is tired from the gait training, the seat members 70R and 70L are rotated around attachment shafts thereof to reduce the gap between the seat members 70R and 70L to move the seat members 70R and 70L closer to each other, thus forming the seat surface 7 as depicted in FIG. 6. Subsequently, the position of the main body 2 is lowered to allow the care receiver to sit on the seat surface 7 to take a rest.

Moreover, in the form depicted in FIG. 6, the care support apparatus 1 can be used as a self-propelled wheelchair by adding driving means to the first wheels 5R and 5L to control the rotation of the first wheels 5R and 5L.

A second embodiment will be described.

Figure 7:
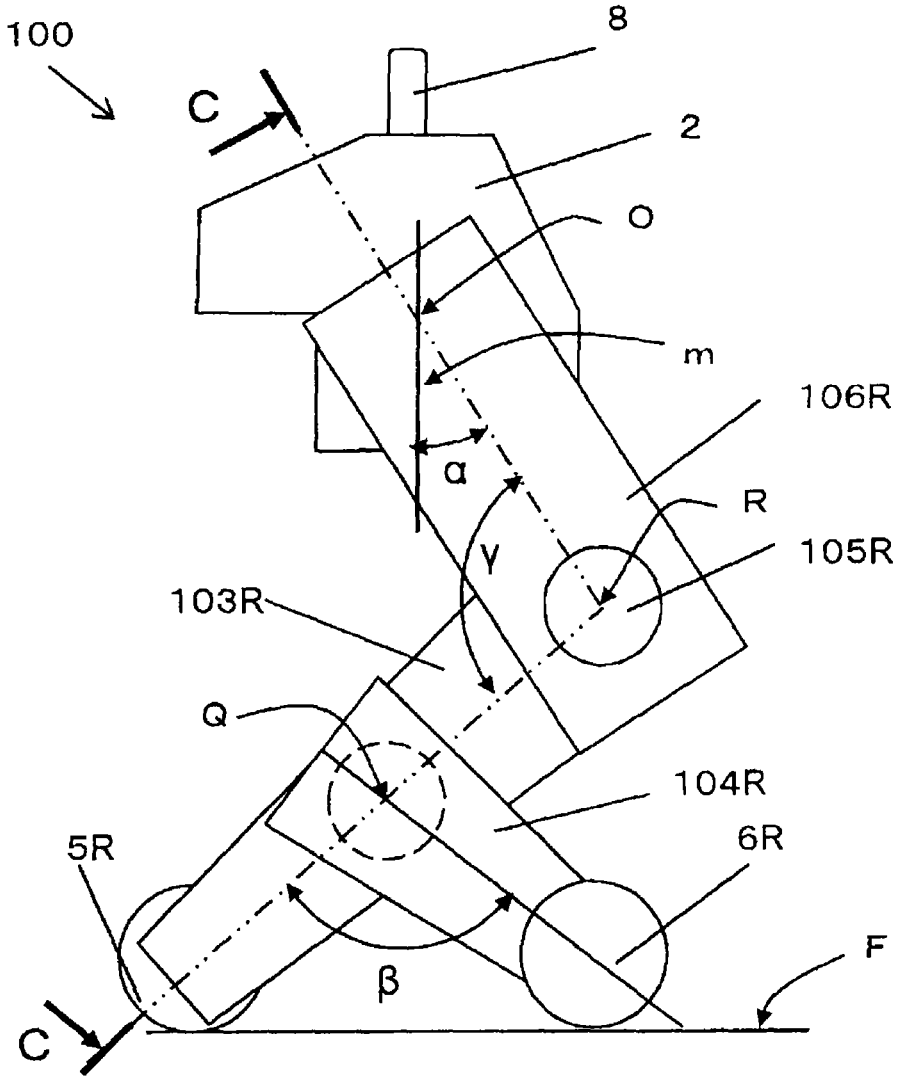
FIG. 7 is a side view depicting a second embodiment.
Figure 8:
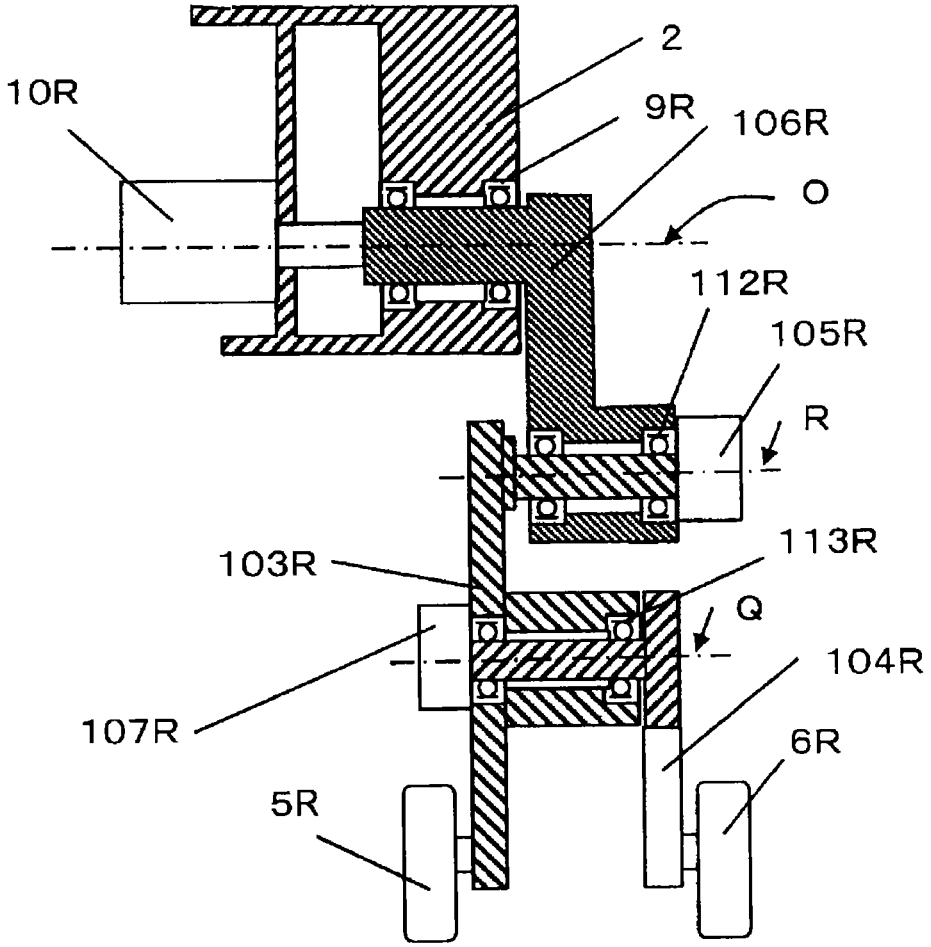
FIG. 8 is a sectional view taken along line C-C in FIG. 7.

As depicted in FIG. 7 and FIG. 8, a care support apparatus 100 in the second embodiment corresponds to the care support apparatus 1 of the first embodiment in which a third link is added to one end of the first link 3R. The form of the care support apparatus 100 thus has an increased degree of freedom.

In a sectional view of a right leg link depicted in FIG. 8, a third link 106R and the main body 2 are rotatably engaged with each other via a fourth axis O defined by the two bearings 9R. The third link 106R is rotationally driven by the motor 10R with respect to the main body 2. A first link 103R and the third link 106R are rotatably engaged with each other via a third axis R defined by two bearings 112R. The first link 103R is rotationally driven by a motor 105R with respect to the third link 106R. The first link 103R and a second link 104R are rotatably engaged with each other via a first axis Q defined by two bearings 113R. The second link 104R is rotationally driven by a motor 107R with respect to the first link 103R. In a left leg link, a first link, a second link, and a third link are similarly rotationally driven by motors.

In a side view of the right leg link depicted in FIG. 7, an angle $\alpha$ is subtended between the line m perpendicular to the ground surface F of the care support apparatus 100 and a straight line joining the fourth axis O with the third axis R. An angle $\beta$ is subtended between a straight line connecting the third axis R with the center of rotation of the first wheel 5R and a straight line joining the first axis Q with the center of rotation of the second wheel 6R. An angle $\gamma$ is subtended between the first link 103R and the third link 106R.

The angle $\alpha$ is controlled by the motor 10R, the angle $\beta$ is controlled by the motor 107R, and the angle $\gamma$ is controlled by the motor 105R. An appropriate combination of the three angles allows the care support apparatus 100 to assume a form that matches the care receiver's positions ranging from the sitting position to the standing position.

In the description of the embodiments, the main body 2 is at the constant angle with respect to the ground surface F. However, the angle may be changed when the form of the care support apparatus is changed.

When the care support apparatus 1 is not used as a wheelchair, the seat surface 7 may be removed from the structure.

What is claimed is:

1. A care support apparatus comprising:

a main body;

a lateral pair of first legs held by the main body, wherein a first wheel is provided at one end of each of the first legs;

a second leg provided with a second wheel at one end of the second leg and coupled to the first leg at another end of the second leg, so as to be rotatable on the first leg around a first axis;

a seat member held by the main body, wherein the main body is rotatably coupled to another end of the first legs so that the first legs are rotatable on the main body around a second axis parallel to the first axis;

a first actuator for driving the second leg around the first axis such that the first wheel and the second wheel approach each other; and a second actuator for driving the first leg around the second axis in coordination with the first actuator driving the second leg around the first axis such that the angle of the main body with respect to the ground is maintained at a desired angle when the first wheel and the second wheel are in contact with a ground surface and the first actuator drives the second leg around the first axis such that the first wheel and the second wheel approach each other, wherein when the first wheel and the second wheel are in contact with a ground surface, and the second leg is rotated by the actuator around the first axis such that the first wheel and the second wheel approach each other, a height of the seat member and the main body from the ground surface increases.

2. The care support apparatus according to claim 1, further comprising:

a pair of said seat members held by the main body, wherein said seat members are movable by approaching each other to provide the seat member.

3. The care support apparatus according to claim 1, wherein the actuators are motors.

4. The care support apparatus according to claim 1, wherein the desired angle maintains the main body at a constant angle with respect to the ground surface.

5. A care support apparatus comprising:

a main body;

a seat member held by the main body;

a lateral pair of first legs, wherein a first wheel is provided at one end of each of the first legs;

a second leg provided with a second wheel at one end of the second leg and coupled to the first leg at another end of the second leg, so as to be rotatable on the first leg around a first axis;

a third leg, wherein one end of the third leg is rotatably held by the main body so as to be rotatable around a second axis parallel to the first axis and another end of the third leg is coupled to another end of the first leg so as to be rotatable around a third axis parallel to the first axis;

a first actuator for driving the second leg around the first axis such that the first wheel and the second wheel approach each other;

a second actuator for driving the third leg around the second axis;

a third actuator for driving first leg around the third axis, wherein the first, second and third actuators operate in coordination such that the angle of the main body with respect to the ground is maintained constant when the first wheel and the second wheel are in contact with a ground surface and the first actuator drives the second leg around the first axis such that the first wheel and the second wheel approach each other, wherein when the first wheel and the second wheel are in contact with a ground surface, and the second leg is rotated by the actuator around the first axis such that the first wheel and the second wheel approach each other, a height of the seat member and the main body from the ground surface increases.

6. The care support apparatus according to claim 5, wherein the desired angle maintains the main body at a constant angle with respect to the ground surface.

* * * * *